US008001733B2

(12) United States Patent
Chen

(10) Patent No.: US 8,001,733 B2
(45) Date of Patent: Aug. 23, 2011

(54) ADJUSTABLE JACK POST

(76) Inventor: Min Chen, Fremont, CA (US)

( * ) Notice: Subject to any disclaimer, the term of this patent is extended or adjusted under 35 U.S.C. 154(b) by 0 days.

(21) Appl. No.: 12/592,844

(22) Filed: Dec. 4, 2009

(65) Prior Publication Data

US 2011/0131893 A1 Jun. 9, 2011

(51) Int. Cl.
*B66F 3/08* (2006.01)
*E21D 15/00* (2006.01)

(52) U.S. Cl. ..... 52/126.4; 254/98; 254/92; 254/93 A; 254/100; 52/126.6; 52/632; 248/354.3; 405/290

(58) Field of Classification Search ..... 52/126.1, 52/126.4, 126.5, 126.6, 632; 248/354.3, 248/354.1, 354.6; 256/102, 100, 7 R, 7 B, 256/88; 405/290; 254/98, 92, 93 A, 100
See application file for complete search history.

(56) References Cited

U.S. PATENT DOCUMENTS 2,570,282 A * 10/1951 Harold et al. ..... 254/100
2,625,815 A * 1/1953 Black ..... 52/126.1
3,022,043 A * 2/1962 Weiss ..... 254/98
3,222,030 A * 12/1965 Thorpe ..... 254/100
3,236,489 A * 2/1966 Mattocks et al. ..... 254/93 A
3,870,278 A * 3/1975 Lee ..... 254/98
3,904,177 A * 9/1975 Dalton ..... 254/103
4,417,426 A * 11/1983 Meng ..... 52/126.7
4,866,797 A * 9/1989 Vollan ..... 52/126.6
5,664,762 A * 9/1997 Rothbauer ..... 254/103
5,855,360 A * 1/1999 Wurdack ..... 254/100
5,862,635 A * 1/1999 Linse et al. ..... 52/126.6
6,279,860 B1 * 8/2001 Swanger ..... 248/125.2
6,659,428 B2 * 12/2003 Kubota ..... 254/103
7,287,355 B2 * 10/2007 Commins ..... 52/223.14
7,458,562 B1 * 12/2008 Chen et al. ..... 254/103
7,614,200 B2 * 11/2009 Wobben ..... 52/741.14
2004/0182982 A1 * 9/2004 Auman ..... 248/354.1
2010/0001239 A1 * 1/2010 Dufour ..... 254/100
2010/0031587 A1 * 2/2010 Weeks ..... 52/126.6

* cited by examiner

*Primary Examiner* — Brian Glessner
*Assistant Examiner* — Brent W Herring

(57) ABSTRACT

A post adjustable in length as required. The post can be adjusted at any time during and after construction. The post can be used as an extension of a column which requires adjustment in length. The post can be used as a jack. The post is capable of withstanding compression, tension, and dynamic loading. The post can be used to provide support to beams and girders in a house frame.

2 Claims, 2 Drawing Sheets

ADJUSTABLE JACK POST

REFERENCE CITED

U.S. Patent Documents

| | | |
|---|---|---|
| 1,222,234 | July 1916 | Muller |
| 1,796,173 | July 1929 | Warren |
| 2,504,291 | July 1945 | Afderfer |
| 2,570,282 | June 1946 | Speck |
| 3,027,140 | March 1962 | Holzbach |
| 3,831,329 | August 1974 | Lear |
| 5,666,774 | September 1997 | Commins |

BACKGROUND OF THE INVENTION

In the building construction industry there are many uses for posts whose length can be adjusted during and after construction. Examples include situations where the ground level is uneven, floor beams sag and need to be adjusted back to level, shoring elevated concrete form works, and where the post be placed on expansion soil, resulting in uneven elevations when the soil is moistened or dried.

Various prior art devices were developed to provide an extendable and retractable structure extending between two structure members. For example, U.S. Pat. No. 3,831,329 steel piers. The device has a small adjustable length, but cannot be used in vibrating conditions such as in supporting girders in the house. Another example is U.S. Pat. No. 3,027,140 which employs the same principle as U.S. Pat. No. 3,831,329. The above mentioned two patent and those listed on the reference prior arts have the same working principle—all of them move a thread rod up and down by adjusting the length of a post, forcing the thread rods to compress when holding weight. This limits the adjustable length of the post. The compression capacity will reduce with increasing length due to the stability effect. Other drawbacks of those devices include their inability to withstand dynamic loads, since their adjustment nut sits directly on top of lower part of the post, and the lack of restriction in either horizontal directions as well as upward direction.

The invention has radically different working principles as all prior art. When changing the length of the system, its adjustment thread rod undergoes tension, and after adjustment the system is restricted from movement in all directions, including horizontal and vertical. This alone provides substantial advantages over all prior arts. It can be used in anywhere a post support required or used as a jack at the same time. The maximum capacity of the system can match a steel rod's yield stress. The invention can be used in vibrating conditions such as houses.

BRIEF DESCRIPTION OF THE INVENTION

Figure 1:
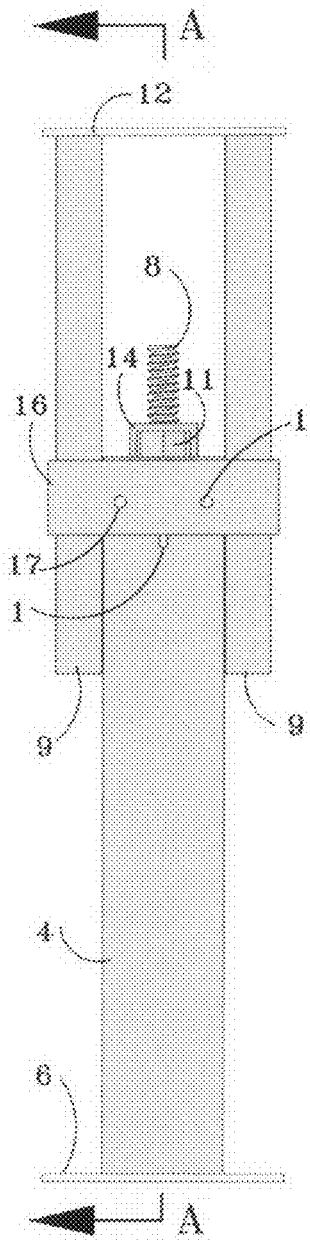
FIG. 1 is the front elevation view of the invention.
Figure 2:
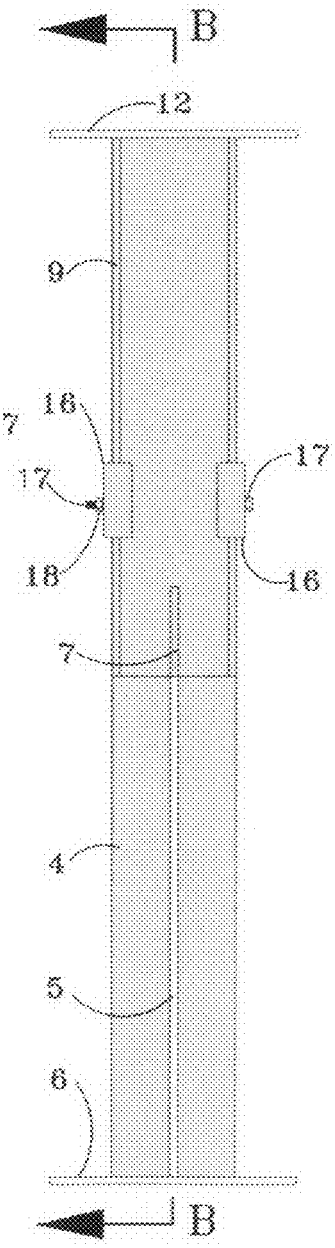
FIG. 2 is the side elevation view of the invention.

The present invention consists of two structural parts joined by a tension thread rod to form a system. The length of the system changes as the nut on the thread rod is tightened or loosened.

The fixed lower part of the system includes: a pair of tabs 1 be fixed to a pipe 2 on opposite sides forming a bearing part, which then inserts into the slots 3 which on an end of the tube 4. Next, the pair of the tabs 1 is fixed to tube 4. A pair of long slots 5 which on another end of steel tube 4 will allow the future tabs 7 of the upper part of the system move alone the slots. The base plate 6 will be fixed with tube 4 after the two parts of the system are joined. Four holes 13 on tube 4 will receive connection bolts 17 in the final to hold bent plate 14 and bent plates 16 to prevent any upward and horizontal relative movements of upper part with the lower part. Four holes 20 on base plate 6 will be used to connect system with its supporting member in the future.

The moveable upper part of the system includes: a pair of tabs 7 be fixed to a tension thread rod 8 on opposite sides forming an adjustable part. Then the tabs 7 insert into slots 10 on two channel-shaped members 9. Next, the pair of tabs 7 is fixed to channel shaped members 9. A cap plate 12 will be fixed with the two channel-shaped members 9 after the system is assembled. Four holes 21 on cap plate 12 will be used to connect system with its supported member in the future.

Joining upper part and lower part forms system kit: Attachment of the upper part of the system to the lower part (from the bottom of the lower part to let a pair of tabs 7 through a pair of long slots 5 on tube 4 and tension thread rod 8 of upper part through the pipe 2 of lower part.) A nut 11 then holds the two parts together to form the system. Base plate 6 and cap plate 12 will then be fixed with tube 4 and channel shaped members 9 respectively. This forms the basic system kit. Now the system can change length by tightening or loosening the nut 11.

If the system will undergo vibration and upward movement, a bent plate 14 with a hole 15 will go through from the top of tension thread rod 8 down to nut 11. Two bent plates 16 with two holes 19 each are then connected with tube 4 and two channel shaped members 9 from front and rear sides of the system. Two bolts 17 then connect the bent plates 16 and tube 4 through the holes 13 on the tube 4 and holes 19 on the bent plates 16. The two bolts 17 also hold bent plate 14 at the same time. Two nuts 18 on the opposite of the bolts 17 are tighten to prevent any movements between the upper part and lower part of the system. The bent plate 14 which is hold by two bolts 17 will prevent upward movement of moveable upper part under uplift force while two bent plates 16 will prevent horizontal movements of moveable upper part under vibration.

OPERATION OF THE INVENTION

Figure 3:
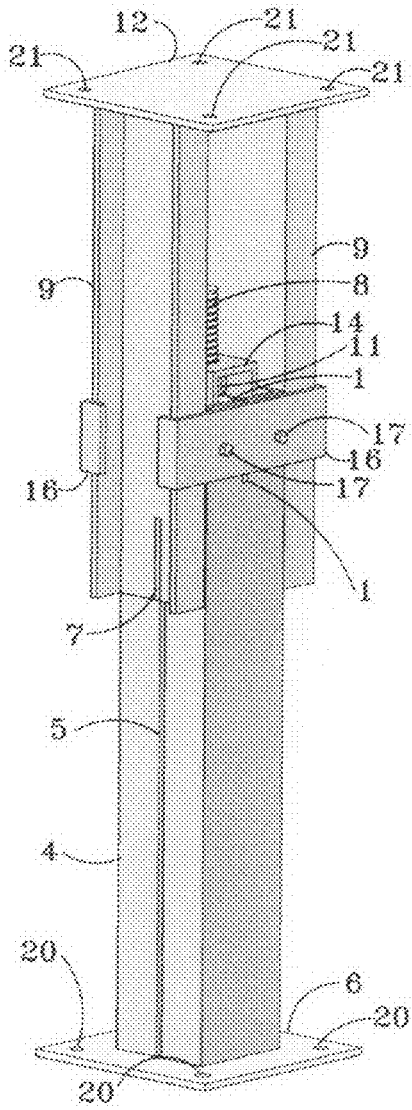
FIG. 3 is the perspective view of the invention.
Figure 4:
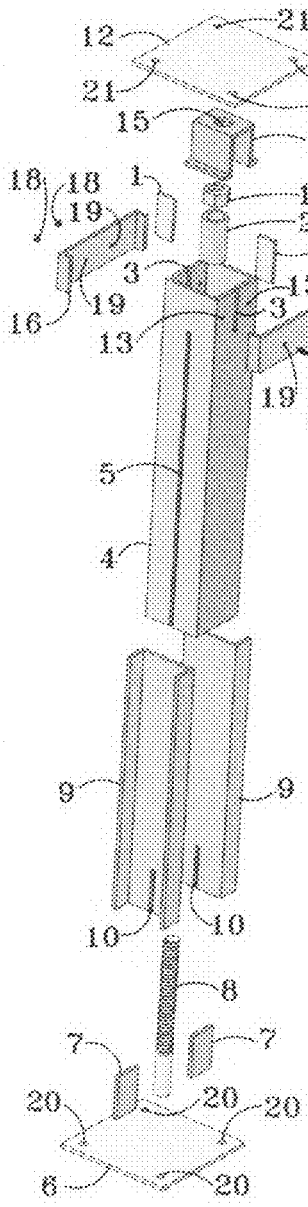
FIG. 4 is the assemble map which takes all system parts apart.
Figure 5:
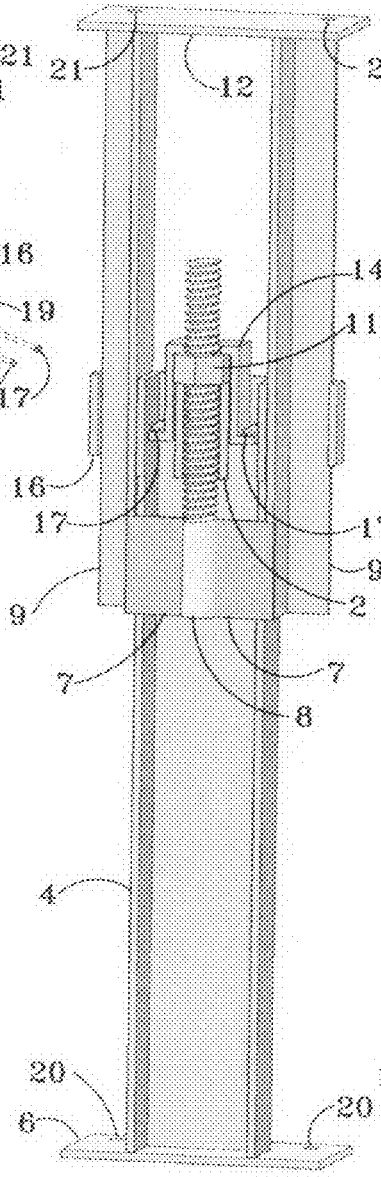
FIG. 5 is the perspective view of cross sectional view of the invention illustrated in FIG. 2 taken alone line B-B.
Figure 6:
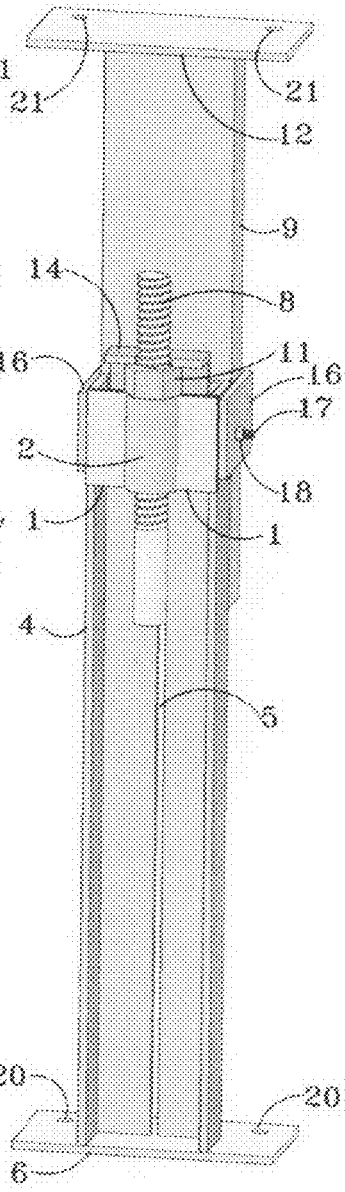
FIG. 6 is the perspective view of cross sectional view of the invention illustrated in FIG. 1 taken alone line A-A.

Operation of the invention is as follows: Referring to FIG. 3. Move the basic system kit to the location where it is to be set up. Move the upper part of the system to desired height against the supported structure member. Tighten the nut 11 until the system completely carries the load from supported structure member or the supported structure member to be jacked to the proper elevation. Where the adjusted post is subject to vibrate load, install bent plate 14 by sliding the bent plate 14 down through the tension thread rod 8 all the way to top of nut 11, add bent plates 16 at front and rear of the system, and finally install the two bolts 17 and secure the bolts by nuts 18 from opposite to the system to prevent any horizontal or uplift movements of moveable upper section. Add bolts or screw to the holes 20 on base plate 6 and holes 21 on cap plate 12 to connect their contact members respectively.

While the above description contains many specifics, they should not be construed as limitations upon the scope of the invention, but rather as a typical example of one preferred embodiment thereof. Many other variations are possible. For example, the base plate 6 and cap plate 12 can be differently shaped to accomplish their supporting or supported member respectively. The tube 4 and channel shaped members 9 also can be in different shapes. In addition, steel or other high strength materials can be used in the invention.

REFERENCE NUMBERS IN DRAWINGS

| | | | |
|---|---|---|---|
| 1 | tab | 2 | pipe |
| 3 | slot | 4 | tube |
| 5 | long slot | 6 | base plate |
| 7 | tab | 8 | tension thread rod |
| 9 | channel shaped member | 10 | slot |
| 11 | nut | 12 | cap plate |
| 13 | hole | 14 | bent plate |
| 15 | hole | 16 | bent plate |
| 17 | bolt | 18 | nut |

-continued

| | | | |
|---|---|---|---|
| 19 | hole | 20 | hole |
| 21 | hole | | |

I claim:

1. An adjustable jack post assembly comprising:

a. a moveable upper part having a structure part fixed to a lower end portion of an adjustable threaded tension rod whereby a compressive force in said structure part is transferred to a tensile force in said adjustable threaded tension rod, and b. a fixed lower part, and c. means for forming said adjustable jack post by coupling the adjustable threaded tension rod of said moveable upper part with said fixed lower part, whereby the total length of the adjustable jack post changes as the adjustable tension threaded rod is adjusted.

2. The adjustable jack post of claim 1, further including a bent plate securing directly on top of a nut attached to the adjustable threaded tension rod and fixed to the fixed lower part to prevent the moveable upper part from moving upward under tensile force to the adjustable jack post, said bent plate having a central aperture allowing the adjustable tension thread rod to project through.

* * * * *